United States Patent [19]

Anderson et al.

[11] Patent Number: 4,793,396

[45] Date of Patent: Dec. 27, 1988

[54] ADJUSTABLE FABRIC RETAINER FOR A WINDOW BLIND

[75] Inventors: Richard N. Anderson; Donald E. Fraser, both of Owensboro, Ky.; Ren Judkins, Salt Lake City, Utah

[73] Assignee: Hunter Douglas, Inc., Saddle River, N.J.

[21] Appl. No.: 908,412

[22] Filed: Sep. 17, 1986

[51] Int. Cl.[4] ..... E06B 3/94

[52] U.S. Cl. ..... 160/84.1; 160/368.1; 160/178.1; 24/683; 24/458; 24/573

[58] Field of Search ..... 160/84 R, 368 R, 383, 160/403, 178.1; 24/683, 457, 458, 573, 545, 547, 564, 546

[56] References Cited

U.S. PATENT DOCUMENTS

| | | | |
|---|---|---|---|
| 1,934,946 | 11/1933 | Morse | 24/564 |
| 2,113,953 | 4/1938 | Steinberger | 24/564 |
| 3,060,536 | 10/1962 | La Voie | 24/545 X |
| 3,135,034 | 6/1964 | Fauteux | 24/508 X |
| 3,529,653 | 9/1970 | Fey, Jr. | 160/383 X |
| 4,518,025 | 5/1985 | Judkins | 160/84 R |

*Primary Examiner*—Ramon S. Britts
*Assistant Examiner*—Blair Johnson
*Attorney, Agent, or Firm*—Pennie & Edmonds

[57] ABSTRACT

The invention relates to window coverings and in particular to a device for mounting fabric covering to a headrail. The device includes a cord guide holder having a body received in and supported by the headrail. The holder has a flexibly attached tongue which extends from the headrail. A clip attaches to the fabric by receiving the fabric over a torturous path. The tongue mounts to the clip so the flexible connection permits changing the orientation of the clip with respect to the holder body in a vertical, horizontal and twisting plane.

32 Claims, 4 Drawing Sheets

ADJUSTABLE FABRIC RETAINER FOR A WINDOW BLIND

FIELD OF THE INVENTION

The invention relates to the field of window covering and in particular to a means for mounting fabric covering to a supporting member, e.g. a headrail.

BACKGROUND

Sun blinds using for example a cellular or pleated single sheet material for covering windows are known in the art. It is usually a simple matter to mount such cross-sectionally shaped material to a headrail when the opening to be covered is rectangular. The headrail merely captures the uppermost cell, pleat, or flaps formed thereon. The headrail extends parallel to the cells or pleats and permits any number of attachment techniques.

However, when the opening to be covered is trapezoidal or has a slanted top edge, the method of retaining the fabric becomes more complicated. This is due in part to the fact that the cells or pleats of the blind that contact the headrail are of different lengths and usually terminate with an open or free end at the rail. Thus, the attachment device must be capable of easy connection and infinite adjustment of angle of attachment.

SUMMARY OF THE INVENTION

The invention therefor is to provide a novel retaining device for attaching the window covering to the headrail. The retaining device has an attachment means which may be a substantially U-shaped fabric clip to grip the fabric of the cellular, honeycomb or pleated window covering. The clip has protuberances on the inner surface of the U-shaped pieces. The protuberances create a torturous path for the fabric to provide a strong grip. Preferably, however, the clip is biased toward a closed position in order to cause at least one tooth to penetrate the material and provide a positive grip.

A separate cord guide holder rides within the support member which is similar to a blind headrail. The cord guide holder is rectangular and extends slightly downward on at least one corner. This slight downward extension permits the corner to positively engage ribs formed within the headrail. The positive engagement of the corner and rib prevents the movement of the cord guide holder within the headrail. When adjustment is necessary the cord guide holder is pushed inward to disengage the corner and rib and thus permit adjustment.

A ribbed or serrated tongue on the cord guide holder extends from the headrail to engage in a ratcheting holder on the fabric clip. The tongue is split and the holder T-shaped. This permits a portion of the tongue to extend on either side of the leg of the "T" thus creating additional stability.

A cord guide is provided in the cord guide holder. In the described embodiment, a separate cord guide is inserted into a central opening in the cord guide holder at locations where lift cords are to extend through the blind. The cords are threaded through the headrail, over the cord guides and down to a bottom rail. In normal use pulling on the cord to raise the blind will create forces which tend to move the cord guide holder. However, the positive engagement of the corner of the cord guide holder and the rib of the headrail will prevent this movement. The cord guide is provided with wings which bias the cord guide holder into engagement with the rib of the headrail. Pushing inward on the cord guide holder flexes the wings to permit movement of the holder.

The tongue of the holder is adjustable and permits positioning the fabric attachment clip at a compound angle to the headrail. The clip therefor can be used with pleated, flat or cellular coverings. However, if a large quantity of retaining devices are made for uniform application, it may be cost effective to produce the holder with the tongue at a preset angle compatible with the angle and orientation of the blind material.

The device of the invention permits adjustment of the fabric position relative the support member. Therefore, when a cut is made in the blind material to conform the material to the converted opening, any variation in the cut line may be compensated for by adjusting the distance. The attachment means extends from the support member and the position of the free edge of the material relative to the attachment means.

DESCRIPTION OF THE PREFERRED EMBODIMENT

Figure 1:
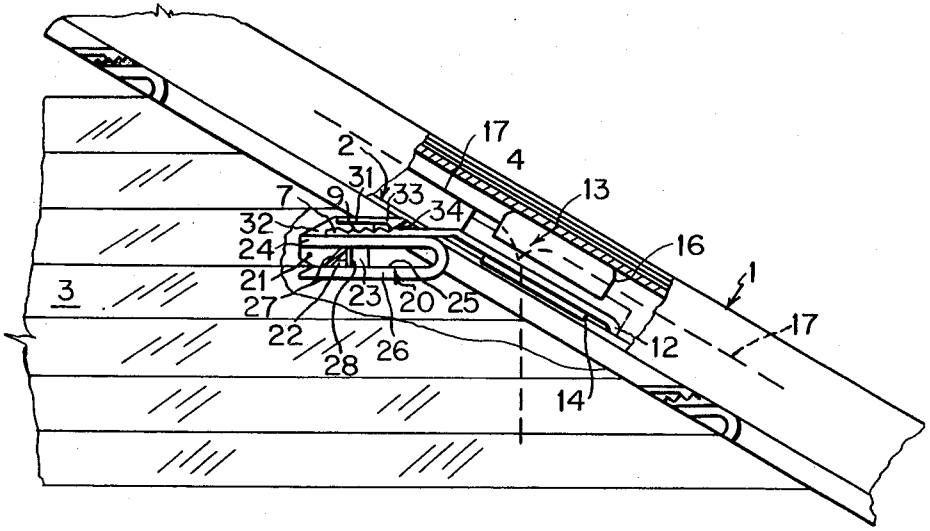
FIG. 1 is a partially broken away front view of a support member and cellular blind using the attachment device of the present invention.
Figure 2:
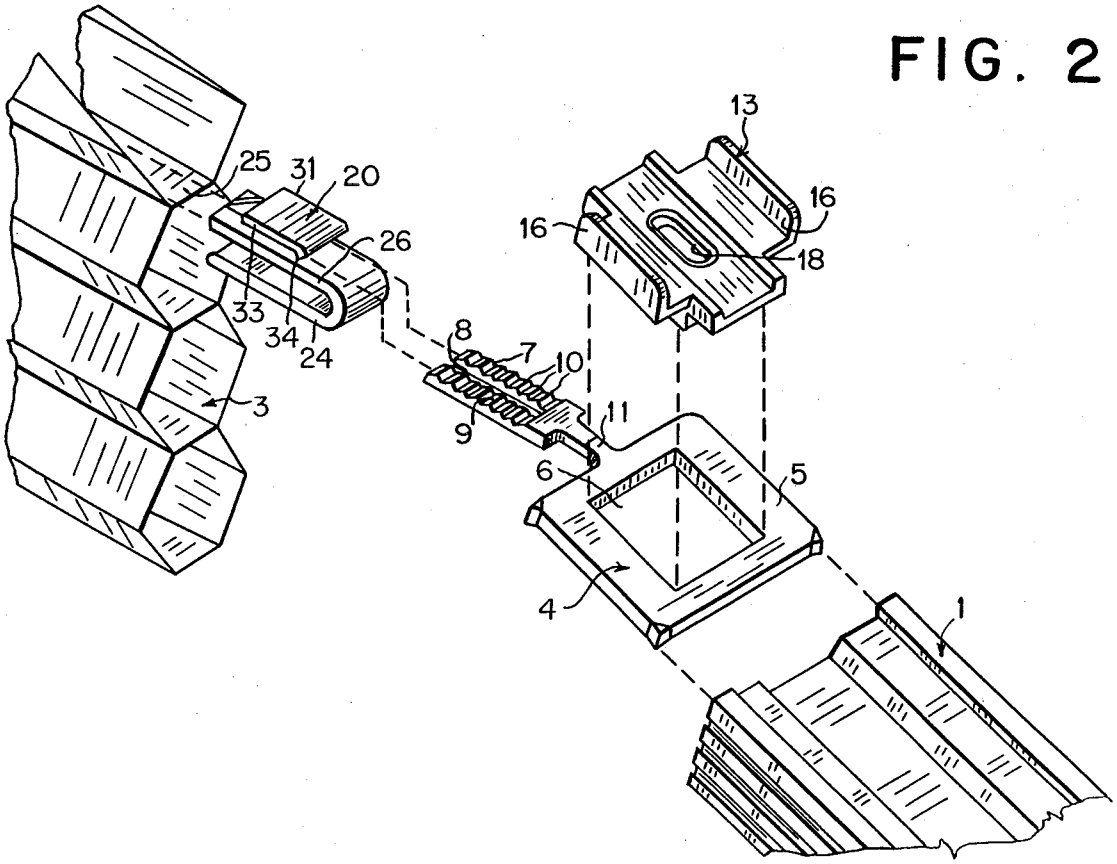
FIG. 2 is an exploded view of the attachment device, support member and blind.

Referring to FIGS. 1 and 2 there is shown the assembly of the invention. A support member is provided in the form of headrail 1 shown having front and back walls with inturned bottom edges to form a longitudinal slot in a known manner. The top surface 2 is provided with ribs or serrations. The headrail 1 extends at a predetermined angle along one end of the blind material and mounts above an opening to hold blind 3 thereover. Blind 3 has opposite ends and opposite sides extending between the ends. The blind is shown in the figures as a honeycomb cellular blind. However, it may be pleated, flat or otherwise constructed. Further, the support member is not limited to a headrail but may, in fact, take other forms; for example, the support member may be the window frame. .

Figure 7:
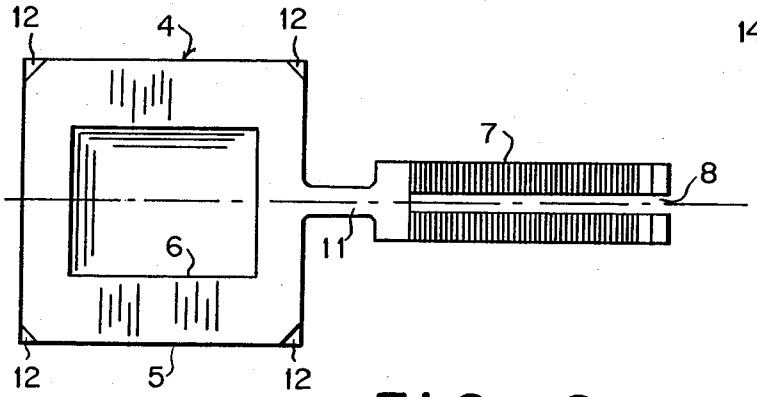
FIG. 7 is a top view of the cord guide holder of the present invention.

A cord guide holder 4 is provided. The cord guide holder 4 has a substantially rectangular shaped body 5 (FIG. 7) which defines a central opening 6. Extending from one end of the holder 4 is an elongated tongue 7 which is divided into two portions by central slot 8. At least one surface 9 has ribs 10. The tongue 7 is connected to the body 5 by a adjustable connecting bridge 11. Bridge 11 permits the tongue 7 to be positioned at a compound angle to body 5, that is, the tongue 7 can be moved in a vertical plane, horizontal plane and twisted with respect to body 5. The tongue 7 may thereby be positioned at an angle compatible with the attachment between the blind material and support member. Holder 4 is preferably made of mild steel, and bridge 11 is therefore a malleable connection which can be bent to position and held. Alternatively the connection is flexible.

Figure 3:
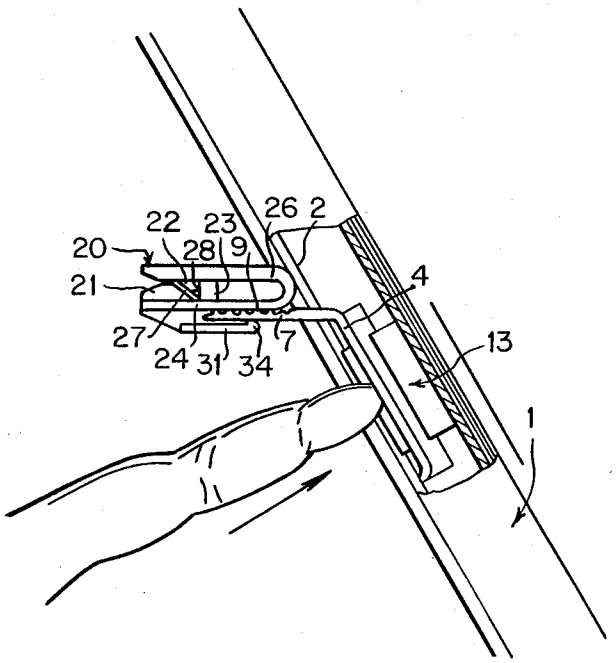
FIG. 3 is a broken away front view showing the disengagement of the cord guide holder from the support member.
Figure 8:
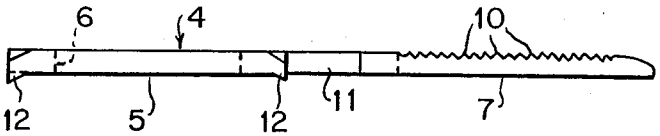
FIG. 8 is a side view of the cord guide holder.

At least one and preferably all four corners 12 of body 5 angle downward slightly (FIG. 8). In this way corners 12 form barbs which engage the ribs of top surface 2 in the headrail 1. Thus, once positioned within the headrail, the cord guide holder 4 maintains its position until it is pushed toward the top of the headrail 1 (FIG. 3) to disengage the bards and ribs.

Figure 10:
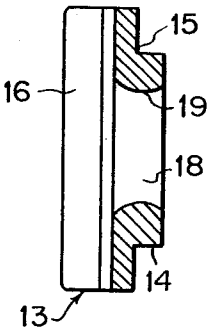
FIG. 10 is a cross-section of the cord guide of FIG. 9.
Figure 11:
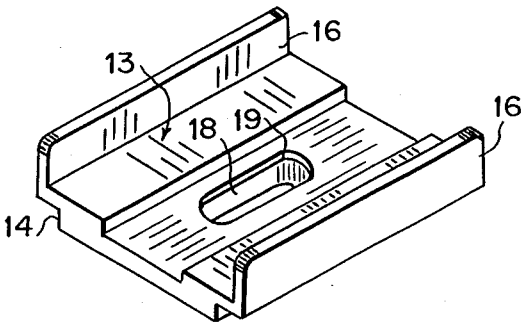
FIG. 11 is a perspective view of the cord guide.
Figure 9:
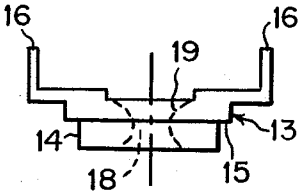
FIG. 9 is an end view of the cord guide of the invention.

The central opening 6 of the cord guide holder 4 receives a cord guide 13 (FIGS. 9–11). The cord guide 13 has a lower bottom portion 14 which fits within opening 6. Shoulder 15 rests on the upper surface of cord guide holder 4. The cord guide 13 extends laterally to two upturned wings 16 which assist in maintaining the lift cords 17 which pass thereover. The wings 16 also engage the upper portion of the support member to bias holder 4 against the top surface 2. Inward pressure on the holder flexes wings 16 to permit movement of the holder. A cord passage 18 is defined in the center of the cord guide 13. The passage 18 permits the cord 17 passing through the headrail to pass down through cord guide 13 to the blind bottom rail for opening and closing the blind. The edges 19 of cord passage 18 are smooth and serve as a turning surface for the cord. Normally, more than one cord is used to raise the blind. Each cord passes downward at a different location. Wings 16 therefor serve to contain and guide cords which pass over cord guide 13 on their path to their respective locations.

Figure 4:
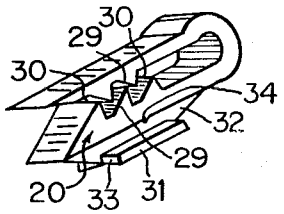
FIG. 4 is a perspective view of an alternative embodiment of the fabric clip.
Figure 6:
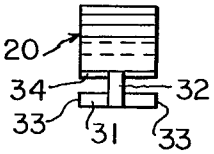
FIG. 6 is an end view of the clip of FIG. 4.
Figure 5:
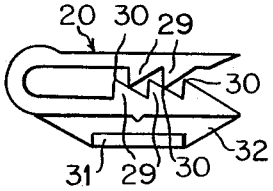
FIG. 5 is a plan view of the clip of FIG. 4.

In order to mount blind 3 to the headrail 1, a clip 20 (FIGS. 1 and 3) is used as an attachment means. Clip 20 may take many forms but preferably is substantially U-shaped to form a jaw. Within the jaw is tooth 21, barb 22 and block 23. Referring to FIG. 1, the relative location of tooth 21, barb 22 and block 23 may be seen. Tooth 21 extends from first leg 24 of the clip 20. When fabric 25 is inserted into the clip 20, tooth 21 holds the fabric against second leg 26. Barb 22 extends from second leg 26 toward first leg 24. The barb 22 forms a sharp corner or point 27. The side of the barb 22 away from the opening of the U-shaped clip extends substantially perpendicular to second leg 26. Block 23 extends from first leg 24 toward second leg 26. Block 23 had a leading surface 28 which complements and extends closely with the perpendicular wall of barb 22. It is easily seen that when the fabric 25 is inserted into the clip 20, the fabric is forced, by tooth 21 and block 23, to turn a sharp corner over barb 22 thus holding the fabric securely. The relative position of the clip 20 and fabric 25 may be adjusted by adjusting the amount of fabric which extends into the clip beyond block 23 in order to correct any variations in the edge of the blind material. Once proper position is obtained, the first and second legs of clip 20 are biased toward one another. This causes the barb 22 to penetrate the fabric 25 slightly to maintain positive grip on the fabric. The clip 20 may alternatively be provided with teeth 29 (FIGS. 4–6) which extend from first leg 24 and second leg 26. The teeth 29 are positioned so their peaks 30 alternate in position thus providing a torturous path for fabric 25.

The clip 20 is provided with mounting means 31 for mounting clip 20 to the cord guide holder 4. The mounting means 31 extends from one leg of the clip 20. A leg 32 extends perpendicular to the outer surface of one of the legs 24, 26. Two arms 33 extend from leg 32 parallel to the outer surface of the clip at a distance approximately equal to the thickness of tongue 7. At least one engaging protrusion 34 extends from either the outer surface of clip 5, the under surface of arms 33 or both. The tongue 7 is inserted into the mounting means 31 so leg 32 is received within slot 8 and the tongue 7 is sandwiched between the outer surface of clip 5 and arms 33. At least one protrusion 34 engages ribs 10 of surface 9 thus ratcheting the tongue 7 to the mounting means 31. The relative positions of clip 5 and cord guide holder 4 may be adjusted by moving the tongue 7 within mounting means 31.

We claim:

1. A retaining device for attaching blind material to a supporting member, said blind material having opposite ends and opposite sides extending between the ends with one of said ends extending at a predetermined angle to one side which angle is other than perpendicular so as to define a free edge for said one end and said supporting member extends along said one end and said free edge to support said blind therealong, said retaining device comprising:

(a) a body;

(b) holding means for fixedly connecting said body to said supporting member at a selectable position along the length thereof;

(c) an elongated tongue connected at one end to said body and extending from said body; (d) an adjustable hinge connection between and connecting said one end of the tongue and said body to permit angular adjustment of said tongue relative to said body to an angle compatible with said predetermined angle and the orientation of the blind material along said one edge; and (e) attachment means on the second end of said tongue for attaching a portion of a free edge of said blind material.

2. The retaining device according to claim 1 wherein: said adjustable connection is a bendable connection between the tongue and the body.

3. The retaining device according to claim 2 wherein: said tongue and said body are integrally formed and the material at said one end of the tongue is bendable to define the adjustable connection.

4. The retaining device according to any one of the claims 1–3 wherein:

the attachment means comprises a separable clip removably connected at a first end to said tongue and at the other end to the free edge of the blind material.

5. The retaining device according to claim 4 wherein: means are provided for adjusting the connection of the clip to the tongue to permit adjusting the clips position toward and away from the support member.

6. The retaining device according to claim 4 wherein: said connection between the attachment means and the free edge of the blind material is adjustable to permit adjusting the position of the blind material relative to the attachment means.

7. A retaining device for attaching blind material to a supporting member, wherein the supporting member defines a slot open toward the side at which the blind material is to be connected, said retaining device comprising:

(a) holder means having a body for connecting the retaining device to said supporting member;

(b) an elongated tongue extending from said body;

(c) a bendable hinge connection between and connecting said tongue and said body, said bendable connection being capable of bending so the angle at which said tongue extends from said body may be changed; and (d) a clip on said tongue for receiving and holding a portion of a free end of said blind material.

8. The retaining device according to claim 7 wherein:

(a) said clip is a separate member; and, (b) mounting means are provided on said clip to mount said clip to said tongue.

9. The retaining device according to claim 8 wherein:

(a) said tongue has a surface with at least one rib; and, (b) said mounting means extends from said clip to receive and hold said clip in said tongue by engaging said at least one rib.

10. The retaining device according to claim 7 wherein:

said clip is U-shaped and forms a jaw for receiving and holding said portion of said blind material.

11. The retaining device according to claim 10 wherein:

said jaw provides a torturous path for said portion of the blind material.

12. In combination, the retaining device according to claim 7, and a supporting member, wherein:

(a) the supporting member includes a pair of co-planar upper surfaces which support said body; and (b) said slot is defined between the pair of co-planar upper surfaces which support said body.

13. The combination of claim 12 wherein:

(a) said support member is a headrail having a top with depending front and back walls having spaced inturned free ends defining said slot; and, (b) said front wall, back wall and inturned free ends define an interior of said headrail.

14. The combination of claim 12 wherein:

(a) said upper surface has serrations extending therefrom; and (b) said body has at least one barb which engages said serrations to prevent movement of said body relative to said support member.

15. The combination of claim 14 wherein:

said body has at least one corner and said corner extends downward at an angle to said body to form said at least one barb.

16. The combination of claim 15 wherein:

said body is rectangular and all four corners extend downward at an angle to said body forming four barbs.

17. The retaining device according to claim 7 wherein:

said holder means defines a central opening over the slot, and said central opening receives a cord guide for guiding at least one lift cord of the blind.

18. The retaining device according to claim 17 said cord guide has an opening with smooth edges to provide a turning surface for a cord as it turns out of the headrail and down through said blind.

19. The retaining device according to claim 11 wherein:

said U-shaped clip has first and second legs and at least one leg has a tooth protruding toward the other leg, said tooth is biased toward said other leg to grip blind material which is inserted between said tooth and the other leg.

20. The retaining device according to claim 19 wherein:

at least one tooth is provided on each of the first and second legs, said teeth protrude toward the other leg.

21. The retaining device according to claim 19 wherein:

said at least one tooth on each leg is offset from the at least one tooth of the opposite leg so the teeth form a tortuous path for the blind material.

22. A clip for retaining material of a window blind and mounting to a tongue protruding from a blind supporting member comprising:

(a) a substantially U-shaped body having two legs of the body biased toward one another;

(b) at least one tooth extending from one leg toward the other leg to grip blind material which is inserted between the legs of the body; and (c) a mounting means on one of side legs defining an elongated slot extending generally parallel to the legs of the U for receiving and holding said tongue to mount said clip to said tongue.

23. The clip according to claim 22 wherein:

(a) said at least one tooth includes a protuberance on one leg having a sloped surface extending at an angle to the other leg; and (b) a barb having a sharp angle extends from said other leg and has a surface which mates in face to face contact with said sloped surface.

24. The clip according to claim 23 wherein:

(a) said barb has a second surface which extends perpendicularly to said other leg; and (b) a surface extends from said one leg parallel to said second surface to force the blind material to pass along the sloped surface then down the perpendicular surface of the barb.

25. In combination a blind supporting member and a holder for mounting a clip holding blind material to the blind supporting member, said supporting member defining a slot open toward a side at which the blind material is connected, the holder comprising:

(a) a body for connecting the holder to said supporting member;

(b) an elongated tongue extending from said body to pass through said slot and having said clip thereon; and (c) a flexible connection between said tongue and said body to connect said tongue and body while permitting the angle between said tongue and body to be changed.

26. In combination, the holder according to claim 25 and a blind supporting member, wherein:

(a) said supporting member includes an upper surface at least partially defining said slot; and (b) said body is supported by said upper surface.

27. The combination of claim 26 wherein:

(a) said upper surface is serrated; and (b) said body includes at least one barb to engage said serrations to prevent sliding movement of said body on said upper surface.

28. The combination of claim 27 wherein:

the body is rectangular and each of the corners of said body extends downward at an angle to said body to form at least one barb each.

29. The holder according to claim 25 wherein:

(a) said clip has mounting means thereon which receive and hold said tongue and said mounting means includes at least one leg extending from said clip and (b) said tongue defines a central slot which receives said leg when said tongue is received by said mounting means.

30. A blind comprising a surface of blind material preferably of the pleated or cell type, said blind material having opposite ends and opposite sides extending between the ends with one of said ends extending at a predetermined angle to one side which angle is other than perpendicular so as to define a free edge for said one end and said supporting member extends along said one end and said free edge to support said blind therealong, and a series of retaining devices each comprising:

(a) a body;

(b) holding means for fixedly connecting said body to said supporting member at a selectable position along the length thereof;

(c) an elongated tongue connected at one end to said body and extending from said body;

(d) an adjustable connection between and connecting said one end of the tongue and said body to permit angular adjustment of said tongue relative to said body to an angle compatible with said predetermined angle and the orientation of the blind material along said one edge; and (e) attachment means on the second end of said tongue for attaching a portion of a free edge of said blind material.

31. A retaining device for attaching blind material to a supporting member, said blind material having opposite ends and opposite sides extending between the ends with one of said ends extending at a predetermined angle to one side which angle is other than perpendicular so as to define a free edge for said one end and said supporting member extends along said one end and said free edge to support said blind therealong, said retaining device comprising:

(a) a body;

(b) holding means for fixedly connecting said body to said supporting member at a selectable position along the length thereof;

(c) an elongated tongue connected at one end to said body and extending from said body;

(d) an hinge connection between and connecting said one end of the tongue and said body to mount the tongue to said body at an angle compatible with said predetermined angle and the orientation of the blind material along said one edge; and, (e) separate attachment means connected at one end to said tongue and at the other end of said attachment means to said blind material.

32. The retaining device according to claim 31 wherein:

means are provided for bendably adjusting the connection of the attachment means to the tongue to permit adjusting the clip's position toward and away from the support member.

* * * * *